United States Patent [19]

Dubach et al.

[11] 4,193,519

[45] Mar. 18, 1980

[54] LIQUID DISPENSING CLOSURE HAVING CAPILLARY BORES

[76] Inventors: Werner F. Dubach, Butzackerstrasse 10, CH-8304 Wallisellen; Hansruedi Kessler, Bahnofstrasse 10, CH-8215 Hallau, both of Switzerland

[21] Appl. No.: 860,407

[22] Filed: Dec. 13, 1977

[30] Foreign Application Priority Data

Dec. 15, 1976 [CH] Switzerland ..... 15755/76

[51] Int. Cl.[2] ..... B67D 3/00

[52] U.S. Cl. ..... 222/111; 222/153; 222/484; 222/517; 222/546; 222/547; 222/556; 220/335; 220/339

[58] Field of Search ..... 222/109, 111, 424, 153, 222/484, 498, 517, 545–547, 556, 562, 564, 571; 220/339, 335, 375, 254, 306; 16/150

[56] References Cited

U.S. PATENT DOCUMENTS

| | | | |
|---|---|---|---|
| 2,056,170 | 10/1936 | Deschner | 222/109 |
| 2,096,802 | 10/1937 | Griner | 222/498 |
| 2,687,157 | 8/1954 | Cowan | 16/150 X |
| 2,812,113 | 11/1957 | Beall, Jr. | 222/111 |
| 2,889,966 | 6/1959 | Burt | 222/556 X |
| 3,101,878 | 8/1963 | Bee | 222/543 X |
| 3,117,701 | 1/1964 | Stull | 222/153 X |
| 3,124,281 | 3/1964 | Stull | 222/546 X |
| 3,240,405 | 3/1966 | Abbott | 222/546 X |
| 3,297,213 | 1/1967 | Henderson | 222/562 X |
| 3,311,275 | 3/1967 | Gibson | 222/564 X |
| 3,621,115 | 11/1971 | Kolster | 220/339 X |
| 3,629,901 | 12/1971 | Wolf et al. | 220/339 X |
| 3,752,371 | 8/1973 | Susuki et al. | 222/517 X |
| 3,848,780 | 11/1974 | Stull | 222/546 |
| 3,999,678 | 12/1976 | Ignell et al. | 220/335 X |
| 4,047,648 | 9/1977 | Croyle | 222/111 X |

*Primary Examiner*—Charles A. Marmor
*Attorney, Agent, or Firm*—Darbo & Vandenburgh

[57] ABSTRACT

A body and cap connected by a hinge are integrally molded from plastic. The body is adapted to be connected to a container and has a dispensing spout which may be centered or offset. At the distal end of the spout is a tubular portion surrounded by a channel. Capillary bores extend generally parallel to the axis of the spout from the base of the channel to an interior in the spout. Adjacent the distal end of the spout is a spherical bulge. The cap has an internal opening complementary to this bulge so that the cap fits sealingly thereabout. The body and cap have annular exterior walls which meet in a plane inclined at about fifteen degrees to the horizontal (when the top of the container to which the body is secured is horizontal). Several forms of hinges and components biasing the cap are disclosed.

18 Claims, 7 Drawing Figures

LIQUID DISPENSING CLOSURE HAVING CAPILLARY BORES

BACKGROUND AND SUMMARY OF THE INVENTION

The closure of a liquid container has, besides the function appearing from the designation, "closing", several equally important secondary functions. These are:

(a) The closure should prevent both a leakage of the liquid and loss of the contents due to evaporation.

(b) The closure should be hygienic; i.e., the outlet should not have to be touched with the hand.

(c) The closure should have good drip and spray properties.

(d) The closure should permit the inviolate state of the product to be observed.

(e) The closure should have a high degree of convenience in operation; i.e. simple closing and opening of the cap must be assured.

(f) The closure should have a form appealing to the public, and be advantageous in spray technology.

(g) The closure must not splatter anything in opening and closing.

(h) Possible "tear formation" must not lead to the fouling of the closure.

(i) The closure should not become encrusted by dried residual particles.

The closures obtainable today on the market fulfill these functions rather unsatisfactorly.

The problem of the invention is to provide a closure-with-cap which fulfills the required functions better than the closures hitherto known.

The plastic-material closure-with-cap according to the invention, consisting of a lower part or body that can be slipped on or screwed, sealing with respect to the liquid container, with an outlet bore arranged in a tip and with a cap firmly joined with the lower part, solves this problem by the means that the tip with the outlet bore arranged therein is provided with an annular bulge, in which there is an annular channel in which there are capillary bores passing through the lower part, and that the cap is provided with a member gripping around the bulge.

DESCRIPTION OF SPECIFIC EMBODIMENTS

Figure 1:
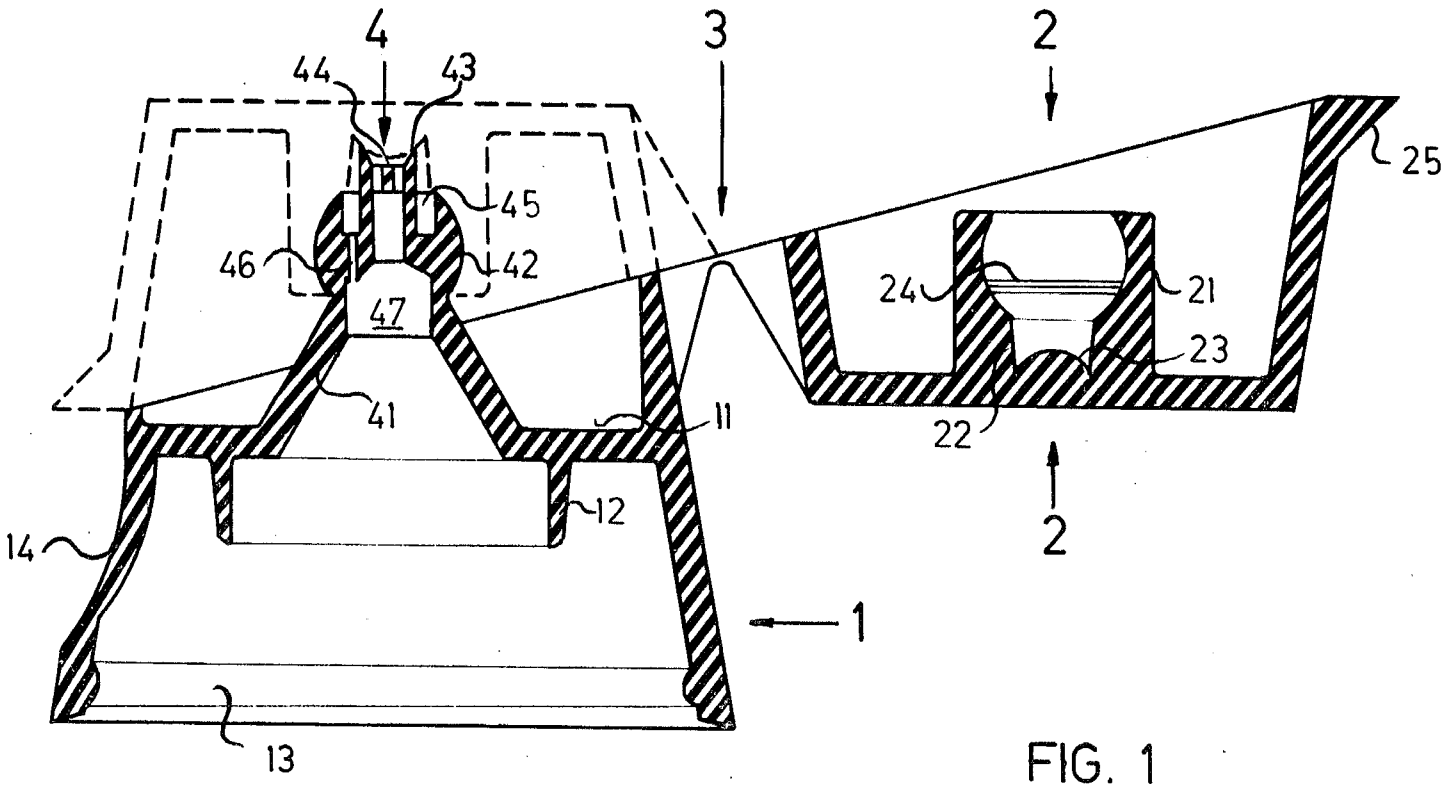
FIG. 1 is a vertical section through a closure with a central positioning of the outlet bore.

The embodiment of FIG. 1 comprises a lower part or body, generally 1, and a cap, generally 2. These are connected by a hinge 3. The cap is shown displaced in full lines and, as mounted on the body, in dashed lines. In the center of the body is an outlet bore, generally 4, through which the contents of the container (not shown) may be discharged.

The most striking part of the closure is the form of the tip with the outlet bore arranged in it. The lowest part of the tip has the form of a straight cone 41. Above and integral with the cone is a ball 42. The distal end of the tip is formed by a tubular part which ends in a conical rim part 43. This tubular part defines part of the outlet bore 4 and a portion of the tubular part is within ball 42 and is integral therewith. A rigidification cross 44 is mounted in the interior of the bore 4 adjacent the distal end of the tubular part. Bore 4 decreases in size from the inner end to the outer end and intermediate its ends has a central opening or hollow space 47 of intermediate size. The outer end of bore 4 is surrounded by an annular channel 45 enclosed in the spherical part of the tip. Capillary bores 46 extend from the channel 45 to the hollow space 47 lying underneath. The capillary bores 46 run parallel to the outlet bore 4. Both the number and also the arrangement of these capillary bores can be arbitrary. The conical part 41 of the tip is surrounded by a gutter 11. On the underside of the gutter 11 is an annular reinforcing rib 12 coaxial with the tip. The lower part 1 also has, further, an indentation 14 for the convenient opening of the cap 2 and an annular bead 13 on the inner side. The annular bead 13 serves for the support and sealing of the lower part 1 to a bottleneck (not shown).

The cap 2 has an engaging member 21 which grips about the bulge or ball 46 in closing position. The engaging member has a central opening and the configuration of the wall defining this opening is complementary to the configuration of the tip with bulge. In the closing position the tubular tip with the outlet bore 4 extends into the conical depression 22 of the member 21 and the spherical raised part 23 bears against the conical rim part 43 to provide a seal at the end of bore 4. The member 21 thereby forms an approximately gastight chamber around the tip. To provide the greatest possible tightness the spherically concave portion of the inner wall of engaging member 21 has sealing grooves 21, which grooves alternatively could be on the annular bead, or the spherical part of the tip. These sealing grooves, represented in the drawing only as thin lines, are in cross section V-shaped raised parts of low height.

The opening and closing of the closure is facilitated on the one hand by the beak 25 arranged on the cap 2 and, on the other hand, by the indentation 14 in the lower part 1. The closure here represented has no snap mechanism.

Figure 2:
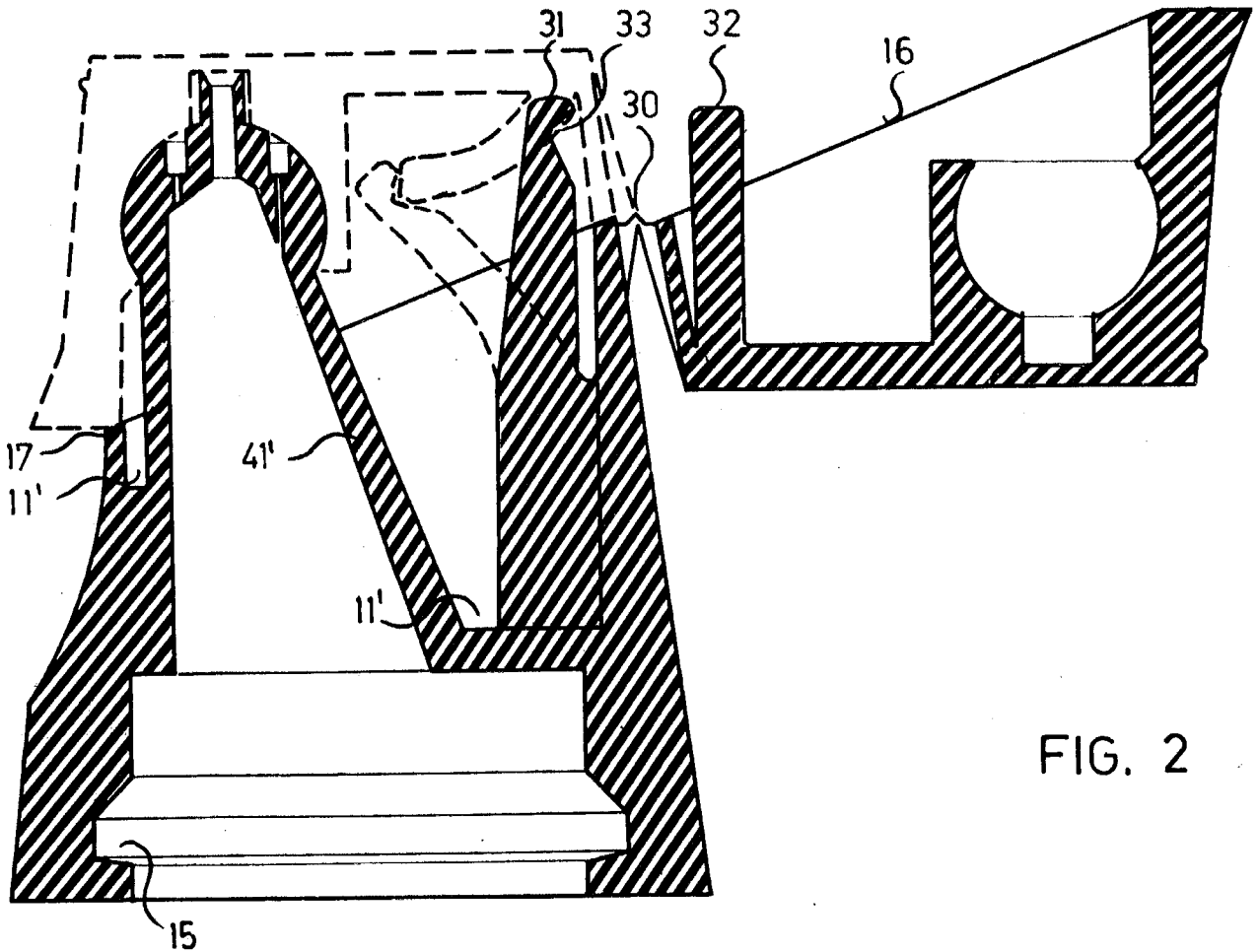
FIG. 2 is a vertical section through another embodiment having an eccentric arrangement of the outlet bore.

The closure represented in FIG. 2 seems at first glance to differ greatly from the closure according to FIG. 1. Actually, however, it has only two theoretical differences. First, the outlet bore is arranged eccentrically in the lower part and, second, there is provided a snap mechanism facilitating the opening.

The basic elements lower part or body 1, cap 2, hinge 3 and outlet bore 4 arranged in a tubular tip, are identical. The lower part of the tip, however, has been modified on account of the eccentric arrangement. Thus, instead of the straight cone 41 there is now an oblique circular cone 41'. Also the shape of the gutter 11 has changed. The gutter 11' does, to be sure, still surround the cone, but no longer runs horizontally and also varies in width. Instead of the bead 13 there is an annular groove 15 performing the same function. However, the parting plane 16 between lower part and cap running at ca. 15° remains the same. This inclination of the parting plane has the advantage of bringing about a strong yielding of the front edge 17 with respect to the outlet bore 4 and permits an advantageous positioning of the hinge 3. Finally the hinge 3 consisting of two short bands 30 one lying in front of and one lying behind the vertical central section plane is constructed the same as in the case of the closure according to FIG. 1.

A new element is presented by the opening mechanism. The mechanism comprises in principle a spring-elastic element. In the present example there are provided two spring-elastic elements in the form of spring rods 31, 32. These spring rods could have molded parts engaging in one another as ball and socket (which would mean a defined opening angle) or, as in the present case, a simple notch 33 in the spring rod 31 secured to the lower part 1.

Figure 4:
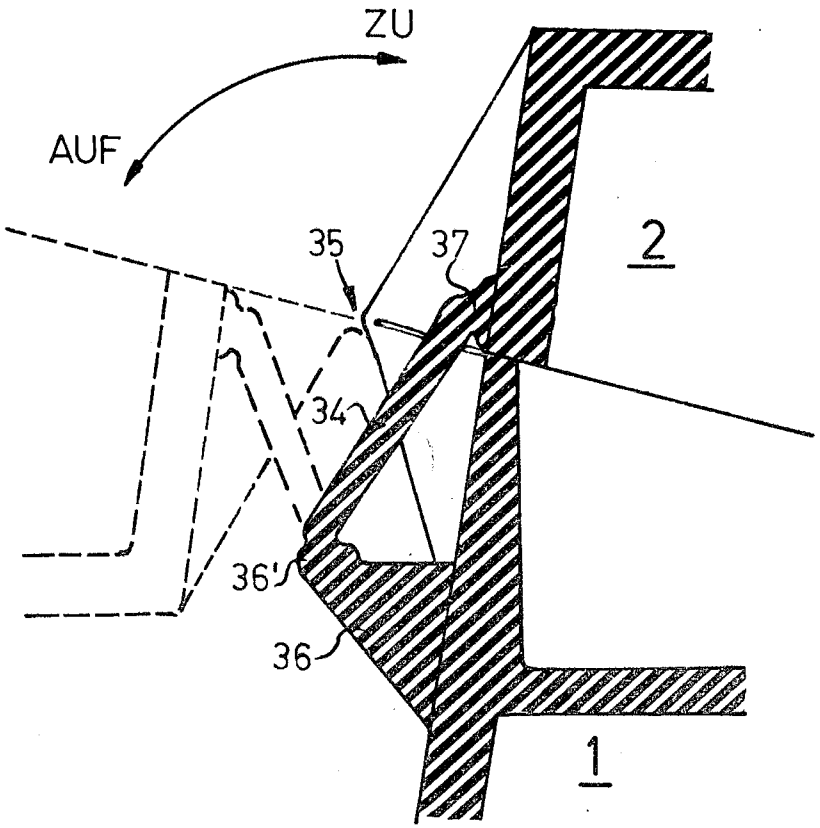
FIGS. 3–5 show vertical sections showing alternative hinge structures.
Figure 3:
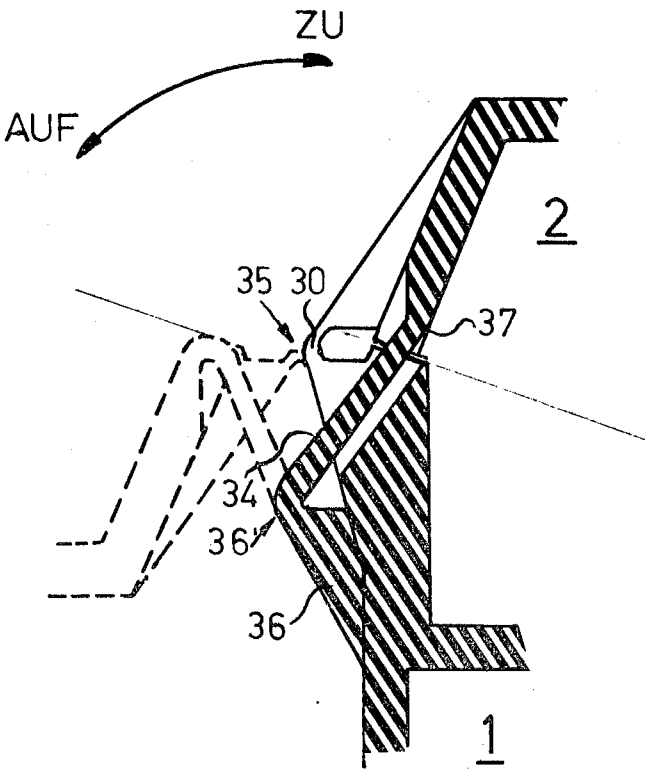

FIGS. 3 and 4 show variants of a hinge for the closure cap in section. As in FIGS. 1 and 2, here the hinges are represented by bands 30, which do not lie in the section plane. In contrast to FIG. 2, here it is a matter not only of opening mechanisms, but of snap action opening and closing mechanisms. The two variants are functionally identical, but have differences in form. Cap 2 and lower part 1 are in the present cases joined with one another by three bands, two being hinge bands 30, and the third being a stretch band 34.

The short hinge bands 30 form a hinging axis 35 for the cap. On the lower part 1 there is a projection 36. A stretchable band 34 extends between this projection and point 37 of the cap. Through the dimensioning of the bands and the suitable choice of the location of the ends 36' and 37 of the stretch band on the lower part 1 and cap 2, there is achieved the closing or opening force required for the snap action. In both end positions, entirely open and closed, the stretch band 34 is in each case relaxed. In the opening of the cap 2 the stretch band is tensioned up to the moment that the stretch band runs in the direction of the connecting line between the points 35, 36 and then jumps automatically into the untensioned, fully open position. Analogously, in closing the cap by hand, closing is carried out until the stretch band has obtained its greatest extension, after which the closure closes automatically.

A suitable choice of material is of determinative importance for such closures with stretch-band snap mechanisms. Polypropylene has proved to be a suitable material.

Figure 5:
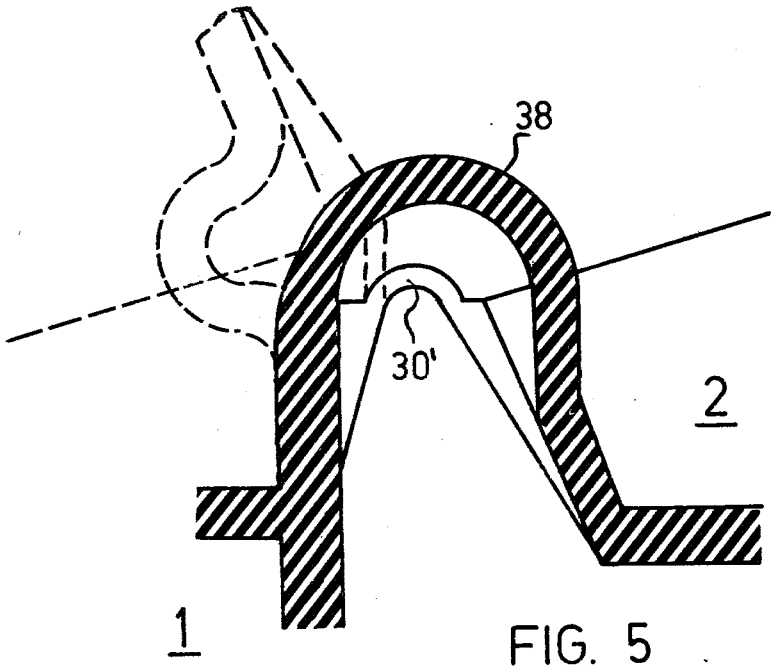

FIG. 5 shows, like FIG. 2, a simple spring mechanism which holds the cap once open in this position. Lower part 1 and cap 2 are here provided with somewhat longer hinge bands 30' and with a spring-elastic element 38 tensioned in the closed state. This spring-elastic element 38 is constructed in arcuate form. Theoretically the manner of functioning corresponds to two spring bars that are joined to hinge with one another.

Figure 6:
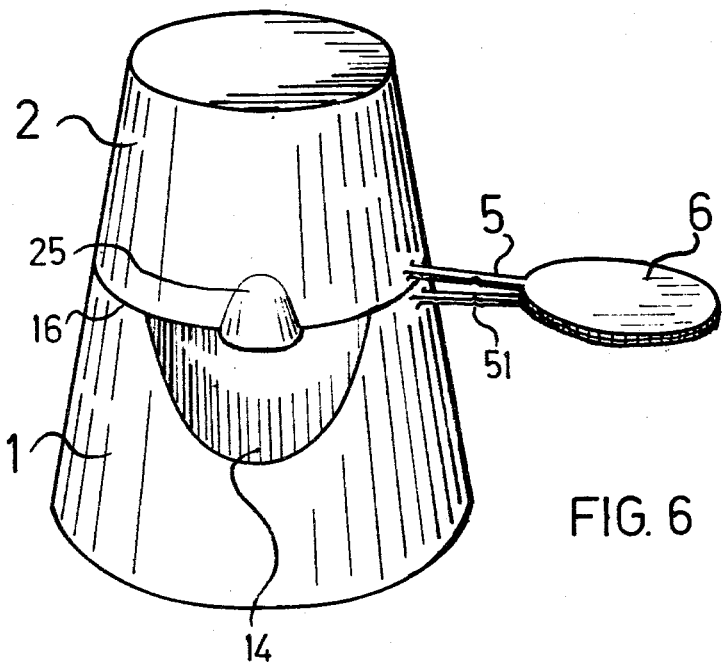
FIG. 6 is a perspective view of a closure with injection-molded disks to provide tamper-proof protection.

FIG. 6 is a perspective view of a closure. The parting plane 16 between lower part or body 1 and cap 2 runs horizontally. Clearly perceptible, too, are the beak 25 and the indentation 14.

Straps 5 lead from the lower part 1 and the cap 2, respectively, to a disk 6. The straps have notches 51 which are to facilitate a twisting off or tearing off of the disk. The disks are undetachably joined with one another. In the example represented the disks are welded together.

The two disks joined with one another present a proof of the inviolate state of the product. An irreversible joining of the two disks, accordingly, is a fundamental precondition. Such irreversible connections are, besides the traditional welding and cementing, plastic joints with irreversible form closure agents.

Besides the main function of guarantee of the inviolate state of the contents, the disks may also perform secondary functions. Thus, for example, in the welding together of the two disks it is possible simultaneously to imprint a durability date, so that the disk becomes a genuine guarantee seal.

In the case of closures for medicine containers it is possible to also apply price data and special storage code to the disk.

Hitherto known closures of this type with a part indicating the inviolate state have a closed outlet opening which is cut off on first use. This results in altogether undefined outflow relations. According to the effect discovered by the Romanian airplane pioneer Coanda and named after him, liquid jets flowing from a tube adhere to the solid wall and can thereby deflect wall jets. Consistently, therefore, in the present closure the outlet bore will have a sharp-edged precisely defined rim portion. This avoids the disagreeable property of such prior art closures wherein the liquid splashes in another direction that that desired.

A second disagreeable property of many closures are the drops running down along the outer wall of the outlet opening. The problem was already perceived and more recent closures have a so-called catching gutter. Through the frequent running back of drops along the wall of the outlet outer wall some liquid accumulates here. In the opening and closing of such a closure equipped with a snap mechanism the user is soiled or spattered.

In the closure according to the invention these "teardrops" flow through the capillary bores 46 back into the container. The danger of gumming up of the outlet bore 4, of the channel 45 or of the capillary tube 46 is prevented by the suitable shaped form of the tip with bulge and of the member 21 in the cap. In the closing the member 21 comes to lie first on the bulge of the tip and forms a hollow space. The air present in the hollow space is now blown in the complete closing in which the member 21 is emplaced around the bulge, through the bores 4 and 46 and the liquid possibly present in the channel or in the bores is pressed into the container.

The capillary bores 46 have, however, still further advantages. If the liquid container, for example a small bottle of liquid seasoning, is used with the closure according to the invention to apply a few squirts of seasoning to the food, the Coanda effect manifests itself especially strongly. The influence of the effect, however, is reduced, since the spraying air flows inwardly through the capillaries, which air, lying on the wall of the outlet bore in the form of micro-bubbles is again ejected, the detaching of the jet from the wall is facilitated and thus the flow behavior is improved. This flow behavior as well, too, as the improved outflow properties through a baffle element (44), for example in the form of a rigidification cross, is represented in FIG. 7.

Figure 7:
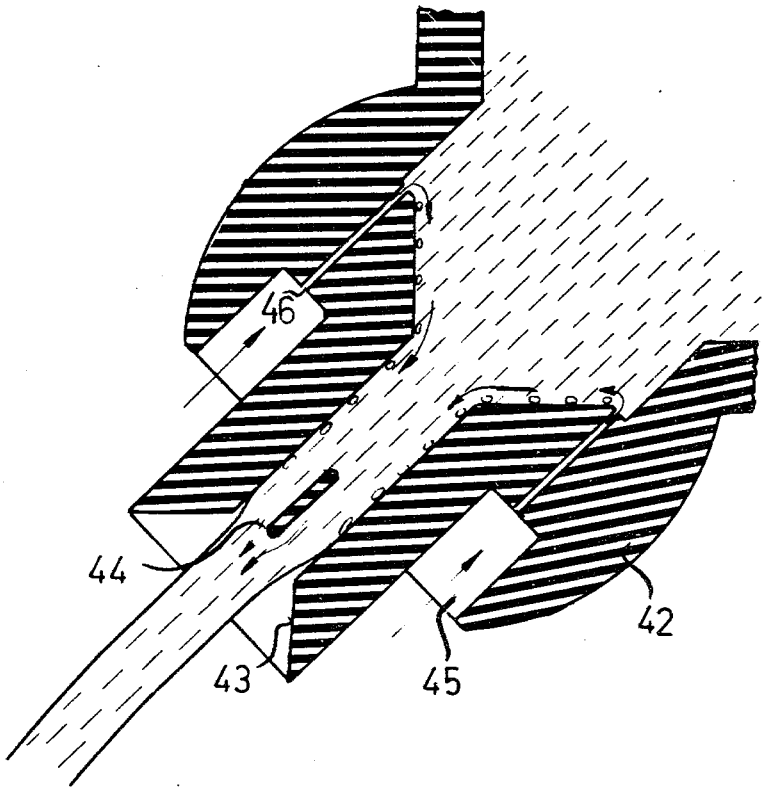
FIG. 7 shows the squirting behavior of the closure.

In FIG. 7, the micro-bubbles are shown being introduced into the flow due to the well-known Venturi effect. As liquid is expelled from a container to which the closure is attached, the decreasing cross-sectional area of the cone 41 (FIG. 1) accelerates the flow velocity as it proceeds to the outlet bore 4, and, according to Bernoulli's Theorem, as the velocity increases, the static pressure must decrease. Hence, air is drawn through the capillary bores and is entrained by the flowing liquid, thus reducing the Coanda effect.

In contrast to spraying, in dripping the air following through the capillary tube can rise in the container and replace the volume of the outflowing liquid.

Finally let it also be pointed out that the closure is well suited for use with a plastic liquid container. Through light pressure on the container the liquid can be well dosed. When the container is released, the inflowing air sucks the liquid from the channel and from the capillaries, so that these always remain open.

In the use of plastic liquid containers there exists the possibility that the air flowing out through pressure on the liquid container will form a bubble that bursts and spatters the user. This is prevented in the closure according to the invention by a baffle element in the outlet bore. The rigidification cross in FIG. 1 takes over in addition the function of the baffle element. A simple strap in the outlet bore, however, would also fulfill this function.

We claim:

1. A plastic closure for a liquid holding container comprising a body and cap, said body being adapted to be secured to the container and including a tip having an outlet bore therethrough, the bore having an inner end and an outer end, said closure being characterized by:

said tip including a tubular part surrounded by an annular bulge, said part and bulge defining an annular channel therebetween adjacent the distal end of the tip, said bore extending through said part and including a central opening intermediate said ends, said bore decreasing in size from said inner end to said outer end whereby as liquid is expelled from the container and flows out through the bore the flow velocity is increased from the inner end to the outer end, said tip including capillary bores extending from said channel to said central opening through which air flows inwardly as the liquid is so expelled and is expelled along with the liquid; and said cap having a member adapted to fit about said tip and engage said bulge.

2. A closure as set forth in claim 1 wherein the exterior of said bulge is generally spherical.

3. A closure as set forth in claim 1, wherein the distal end of the tubular part has a sharp edge.

4. A closure as set forth in claim 3, wherein said distal end has an interior surface of generally conical configuration extending inwardly from the distal end with the base of the cone at said distal end.

5. A closure as set forth in claim 1, wherein said tip is eccentric with respect to the remainder of said body.

6. A closure as set forth in claim 1, wherein said cap and said body are formed about an axis and each has an outer wall surrounding said axis, said outer wall of the cap meeting the outer wall of the body in a plane, said plane being inclined at about fifteen degrees with respect to the horizontal when the top of said container is horizontal.

7. A closure as set forth in claim 1, wherein said member has an internal opening defined by a wall generally complementary to said bulge, said wall having at least one sealing groove therein.

8. A closure as set forth in claim 1 and wherein the cap and body are connected by hinge means, said closure being further characterized by:

means to prevent said cap from being removed from said body without it being apparent that such removal has occurred and comprising a first disc and a strap connecting the first disc to the body; and a second disc and a strap connecting the second disc to the cap;

said discs being permanently affixed to each other.

9. A closure as set forth in claim 1 and wherein the cap and body are connected by hinge means, said closure being further characterized by:

said hinge means comprising two bands adjacent each other.

10. A closure as set forth in claim 1 and wherein the cap and body are connected by hinge means, said closure being further characterized by:

spring-elastic means connecting the cap and body, said means being untensioned when the cap is in the position of being in place on the body and also when the cap is in the position of being fully opened, and being tensioned intermediate said two positions.

11. A closure as set forth in claim 10, wherein said spring-elastic means is a stretch band.

12. A closure as set forth in claim 1 and wherein the cap and body are connected by hinge means, said closure being further characterized by:

spring-elastic means between said cap and body for opening said cap, said means being tensioned when the cap is in closed position on the body.

13. A closure as set forth in claim 12, wherein said spring-elastic means comprises an injection molded spring bar.

14. A closure as set forth in claim 13, wherein said spring bar is arcuate and is secured to both the body and the cap.

15. A closure as set forth in claim 1, wherein said member has an internal opening defined by a wall generally complementary to said bulge, said wall also forming a sealing chamber about the distal end of said tubular part.

16. A closure as set forth in claim 15, wherein said member includes a spherical projection in said chamber and fitting against said distal end of the tubular part when said cap is seated against said body.

17. A closure as set forth in claim 1, including baffle means in said bore adjacent the distal end of said tubular part.

18. A closure as set forth in claim 17, wherein said baffle means is in the form of a cross and serves to rigidify said tubular part.

* * * * *